US006363919B1

(12) United States Patent
Isobe et al.

(10) Patent No.: US 6,363,919 B1
(45) Date of Patent: Apr. 2, 2002

(54) EVAPORATED FUEL TREATMENT APPARATUS FOR INTERNAL COMBUSTION ENGINE

(75) Inventors: Takashi Isobe; Takashi Yamaguchi, both of Saitama; Satoshi Kiso, Tochigi, all of (JP)

(73) Assignee: Honda Giken Kogyo Kabushikikaisha, Tokyo (JP)

( * ) Notice: Subject to any disclaimer, the term of this patent is extended or adjusted under 35 U.S.C. 154(b) by 0 days.

(21) Appl. No.: 09/495,746

(22) Filed: Feb. 1, 2000

(30) Foreign Application Priority Data

Feb. 5, 1999 (JP) ..... 11-029260

(51) Int. Cl.[7] ..... F02M 33/02
(52) U.S. Cl. ..... 123/520; 123/198 D
(58) Field of Search ..... 123/520, 521, 123/518, 519, 516, 198 D

(56) References Cited

U.S. PATENT DOCUMENTS 5,327,873 A * 7/1994 Ohuchi et al. ..... 123/520
5,669,362 A * 9/1997 Shinohara et al. ..... 123/520
5,679,890 A * 10/1997 Shinohara et al. ..... 73/118.1
5,878,727 A * 3/1999 Huls ..... 123/520
6,148,803 A * 11/2000 Majima et al. ..... 123/520
6,223,732 B1 * 5/2001 Isobe et al. ..... 123/520

FOREIGN PATENT DOCUMENTS

JP 07 083125 3/1995

* cited by examiner

*Primary Examiner*—Carl S. Miller
(74) *Attorney, Agent, or Firm*—Seed IP Law Group, PLLC

(57) ABSTRACT

An evaporated fuel treatment apparatus having a correction checking means for detecting the state of change in the internal pressure of the fuel tank when the fuel tank is closed after being placed under atmospheric pressure, a leakage checking means for detecting the state of change in the internal pressure of the fuel tank when the fuel tank is closed after being placed under a negative pressure, and a judgement means for judging the presence or absence of leakage in the fuel tank on the basis of the detection results obtained by the leakage checking means and the correction checking means. The apparatus includes calculating means for calculating the amount of fuel consumption at the time of correction checking and the amount of fuel consumption at the time of leakage checking, and judgement prohibiting means for prohibiting a judgement of the presence or absence of leakage from being made by the judgement means in cases where the amounts of fuel consumption calculated at the time of correction checking and at the time of leakage checking are substantially different. As a result, a judgement of the presence or absence of leakage in the tank system is prevented from being performed in cases where such a judgement might be inaccurate.

12 Claims, 8 Drawing Sheets

EVAPORATED FUEL TREATMENT APPARATUS FOR INTERNAL COMBUSTION ENGINE

FIELD OF THE INVENTION

The present invention concerns an evaporated fuel treatment apparatus for an internal combustion engine which releases evaporated fuel generated inside the fuel tank into the intake manifold of the internal combustion engine. More concretely, the present invention concerns an evaporated fuel treatment apparatus for an internal combustion engine which makes it possible to ascertain the presence or absence of leakage in an evaporated fuel discharge prevention system extending from the fuel tank to the engine intake system.

BACKGROUND OF THE INVENTION

A method for judging the presence or absence of leakage in a tank system is described in Japanese Patent Application Kokai No. Hei 7-83125. In this method, the pressure in an evaporated fuel discharge prevention system is lowered to a specified pressure; next, with the target pressure reduction value of the pressure in the fuel tank alternately set at an upper-limit value and a lower-limit value, a feedback pressure reduction process which gradually causes the pressure in the fuel tank to converge on the target pressure reduction value is performed, and the amount of pressure shift in the fuel tank per unit time is calculated (leak down checking mode). In order to eliminate the effect of vapor on the judgement results, the amount of pressure shift per unit time caused by the evaporated fuel is calculated as a correction value. Judgement of the presence or absence of leakage in the tank system is accomplished on the basis of a value obtained by subtracting the value produced by multiplying the amount of pressure shift calculated in the correction checking mode by a coefficient from the amount of pressure shift calculated in the above-mentioned leak down checking mode. If this value is equal to or less than a specified value, it is judged that the tank system is normal, with no leakage; on the other hand, if this value exceeds the specified value, it is judged that there is leakage in the tank system.

However, in cases where the presence or absence of leakage in a tank system is judged by performing such a leak check and correction check, an accurate correction cannot be performed if there is a great difference between the driving conditions during the correction check and the driving conditions during the leak check. For example, in a case where the vehicle is in stable cruise operation during the correction check, but conditions of acceleration are included in the leak check, the tank system may be judged to be normal even if leakage is present, since the rise in the internal pressure of the fuel tank is reduced during acceleration due to consumption by the engine.

However, the rise in the internal pressure of the fuel tank is accelerated during vehicle deceleration due to factors such as reduced fuel consumption, etc., and the rise in the internal pressure of the fuel tank is retarded (i.e., the internal pressure shifts in the negative pressure direction) during vehicle acceleration due to factors such as increased fuel consumption, etc.

For example, in order to detect leakage caused by a very small hole such as a hole with a diameter of 0.5 mm, a considerable length of time ranging from 30 seconds to 60 seconds is required for the correction check and leak check, so that the driving conditions of the vehicle may vary greatly during the correction check and leak check. In such cases, the difference in driving conditions during the correction check and leak check has an effect on the internal pressure of the fuel tank, and adversely affects the precision with which the above-mentioned judgement of the presence or absence of leakage is made.

Thus, the present invention is directed to overcoming the above-mentioned problems, and to improve the reliability of the above-mentioned judgement.

SUMMARY OF THE INVENTION

An evaporated fuel treatment apparatus is provided, which comprises correction checking means which detects the magnitude or rate of change in the internal pressure of the fuel tank when the fuel tank is closed after being placed under atmospheric pressure, a leakage checking means which detects the magnitude or rate of change in the internal pressure of the fuel tank when the fuel tank is closed after being placed under a negative pressure. Judgement means is included which judges the presence or absence of leakage in the fuel tank on the basis of the detection results obtained by the leakage checking means and the correction checking means. The apparatus further includes calculating means which calculates the amount of fuel consumption at the time of the correction checking and the amount of fuel consumption at the time of leakage checking. Judgement prohibiting means prohibits a judgement of the presence or absence of leakage from being made by the judgement means in cases where the calculated amounts of fuel consumption are substantially different.

The expression that the calculated amounts of fuel consumption are substantially different is defined to mean that the difference is such that it affects the judgement of presence or absence of leakage. Specifically, it means a difference that is greater than a predetermined magnitude, which is determined by experiments or simulation.

According to the invention, because a judgement of the presence or absence of leakage in the tank system is prevented from being performed in cases where such a judgement might be inaccurate, erroneous judgement is avoided and therefore, reliability of the judgement is enhanced.

PREFERRED EMBODIMENT OF THE INVENTION

Figure 1:
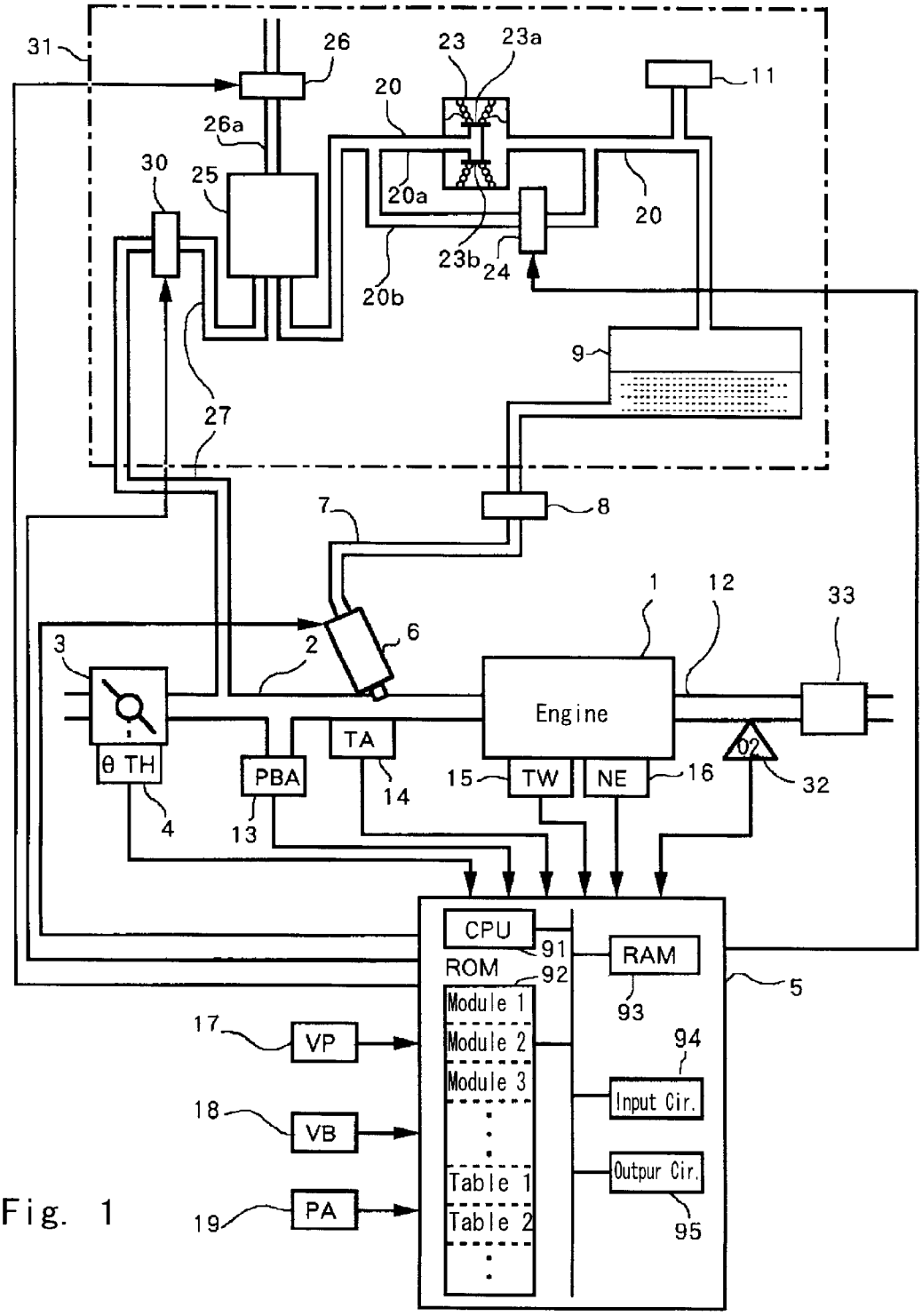
FIG. 1 is a diagram which illustrates the evaporated fuel treatment apparatus of the present invention.

Next, a working embodiment or configuration of the present invention will be described with reference to the attached drawings. FIG. 1 is an overall structural diagram of an evaporated fuel treatment apparatus for an internal combustion engine constructed according to a working configuration of the present invention. This apparatus includes an internal combustion engine (hereafter referred to as the "engine") 1, an evaporated fuel discharge prevention device 31, and an electronic control unit (hereafter referred to as the "ECU") 5.

The ECU 5 includes a central processing unit (CPU) which performs operations in order to control various parts of the engine 1, a read-only memory (ROM) 92 which stores various types of data and programs that are used to control various parts of the engine, a random-access memory (RAM) 03 which provides a working region for operations by the CPU 91, and which temporarily stores data sent from various parts of the engine and control signals that are to be sent out to various parts of the engine, an input circuit 94 which receives data sent from various parts of the engine, and an output circuit 95 which sends out control signals to various parts of the engine.

In FIG. 1, the programs are indicated as module 1, module 2, module 3, etc.; for example, the program which detects the presence or absence of leakage in the present invention is contained in modules 3, 4 and 5. Furthermore, the various types of data used in the above-mentioned operations are stored in the ROM 92 in the form of table 1, table 2, etc. The ROM 92 may be a re-writable ROM such as an EEPROM; in such a case, the results obtained from the operations of the ECU 5 in a given operating cycle are stored in the ROM, and can be utilized in the next operating cycle. Furthermore, a substantial amount of flag information set in various processes can be recorded in the EEPROM and utilized in trouble diagnosis.

For example, the engine 1 is an engine equipped with four cylinders, and an intake manifold 2 is connected to this engine. A throttle valve 3 is installed on the upstream side of the intake manifold 2, and a throttle valve opening sensor (θTH) 4 that is linked to the throttle valve 3 output an electrical signal that corresponds to the degree of opening of the throttle valve 3. This electrical signal is sent to the ECU.

A fuel injection valve 6 is installed for each cylinder at an intermediate point in the intake manifold 2 between the engine 1 and the throttle valve 3; the opening time of these injection valves 6 is controlled by control signals from the ECU. A fuel supply line 7 connects the fuel injection valves 6 and the fuel tank 9, and a fuel pump 8 installed at an intermediate point in this fuel supply line 7 supplies fuel from the fuel tank 9 to the fuel injection valves 6. A regulator (not shown in the figures) is installed between the pump 8 and the respective fuel injection valves 6; this regulator acts to maintain the differential pressure between the pressure of the air taken in from the intake manifold 2 and the pressure of the fuel supplied via the fuel supply line 7 at a constant value. In cases where the pressure of the fuel is too high, the excess fuel is returned to the fuel tank 9 via a return line (not shown in the figures). Thus, the air taken in via the throttle valve 3 passes through the intake manifold 2; this air is then mixed with the fuel injected from the fuel injection valves 6, and is supplied to the cylinders of the engine 1.

An intake manifold pressure (PBA) sensor 13 and an intake air temperature (TA) sensor 14 are mounted in the intake manifold 2 on the downstream side of the throttle valve 3. These sensors convert the intake manifold pressure and intake air temperature into electrical signals, and send these signals to the ECU 5.

An engine water temperature (TW) sensor 15 is attached to the cylinder peripheral wall (filled with cooling water) of the cylinder block of the engine 1; this sensor 15 detects the temperature of the engine cooling water, converts this temperature into an electrical signal, and sends the result to the ECU 5. An engine rpm (NE) sensor 16 is attached to the periphery of the cam shaft or the periphery of the crank shaft of the engine 1; this sensor outputs a signal pulse (TDC signal pulse) at a specified crank angle position with every 180-degree rotation of the crank shaft of the engine 1, and sends this signal to the ECU 5. An electrical engine rpm sensor may also be used, which detects engine rpm from electrical ignition components.

The engine 1 has an exhaust manifold 12, and exhaust gases are discharged via a ternary catalyst 33 constituting an exhaust gas cleansing device, which is installed at an intermediate point in the exhaust manifold 12. An O2 sensor 32 constitutes an air/fuel ratio sensor; this sensor 32 is mounted at an intermediate point in the exhaust manifold 12, and sends a signal indicating air/fuel ratio to the ECU 5.

A vehicle speed (VP) sensor 17, a battery voltage (VB) sensor 18 and an atmospheric pressure (PA) sensor 19 are connected to the ECU; these sensors respectively detect the running speed of the vehicle, the battery voltage and the atmospheric pressure, and send these values to the ECU 5.

The input signals from the various types of sensors are sent to the input circuit 94. The input circuit 94 shapes the input signal waveforms, corrects the voltage levels to specified levels, and converts analog signal values into digital signal values. The CPU 91 processes the resulting digital signals, performs operations in accordance with the programs stored in the ROM 92, and creates control signals that are sent out to actuators in various parts of the vehicle. These control signals are sent to the output circuit 95, and the output circuit 95 sends the control signals to actuators such as the fuel injection valves 6, bypass valve 24, vent shut valve 2 and purge control valve 30, etc.

Next, the evaporated fuel discharge prevention system (hereafter referred to as the "discharge prevention system") 31 will be described. The discharge prevention system 31 includes a fuel tank 9, a charging passage 20, a canister 25, a purging passage 27 and several control valves. This system 31 controls the discharge of evaporated fuel from the fuel tank 9. The discharge prevention system 32 can be conveniently viewed as being divided into two parts, with the bypass valve 24 in the charging passage 20 as the boundary between the two parts. The side including the fuel tank 9 is referred to as the tank system, while the side including the canister 25 is referred to as the canister system.

The fuel tank 9 is connected to the canister 25 via the charging passage 20, and the system is thus arranged so that evaporated fuel from the fuel tank 9 can move to the canister 25. The charging passage 20 has a first branch **20*a* and a second branch 20*b*; these branches are installed inside the engine space. An internal pressure sensor 11 is attached to the fuel tank side of the charging passage 20; this sensor 11 detects the differential pressure between the internal pressure of the charging passage 20 and atmospheric pressure. In a normal state, the pressure inside the charging passage 20 is more or less equal to the pressure inside the fuel tank 9; accordingly, the internal pressure detected by the internal pressure sensor 11 may be viewed as the pressure in the fuel tank 9** (hereafter referred to as the "tank pressure").

A two-way valve 23 is installed in the first branch 20*a*; this two-way valve 23 includes two mechanical valves 23*a* and 23*b*. The valve 23*a* is a positive-pressure valve which opens when the tank pressure reaches a value that is approximately 15 mmHg higher than atmospheric pressure. When this valve is in an open state, evaporated fuel flows to the canister 25 and is adsorbed in the canister. The valve 23*b* is a negative-pressure valve which opens when the tank pressure is approximately 10 mmHg to 15 mmHg lower than the pressure on the side of the canister 25. When this valve is in an open state, the evaporated fuel adsorbed in the canister 25 returns to the fuel tank 9.

A bypass valve 24, which is an electromagnetic valve, is installed in the second branch 20*b*. This bypass valve 24 is ordinarily in an closed state. When leakage is detected in the discharge prevention system 31 of the present invention, the opening and closing action of this valve is controlled by control signals from the ECU 5.

The canister 25 contains active carbon that adsorbs the evaporated fuel. This canister 25 has an air intake port (not shown in the figures) that communicates with the atmosphere via a passage 26*a*. A vent shut valve 26, which is an electromagnetic valve, is installed at an intermediate point in the passage 26*a*. This vent shut valve 26 is ordinarily in an open state. When leakage is detected in the discharge prevention system 31 of the present invention, the opening and closing action of this valve is controlled by control signals from the ECU 5.

The canister 25 is connected to the intake manifold 2 on the downstream side of the throttle valve 3 via a purging passage 27. A purge control valve 30, which is an electromagnetic valve, is installed at an intermediate point in the purging passage 27. The fuel adsorbed in the canister 25 is appropriately purged into the intake system of the engine via this purge control valve 30. The on-off duty ratio of the purge control valve 30 is altered on the basis of control signals from the ECU 5, so that the flow rate is continuously controlled.

Figure 2:
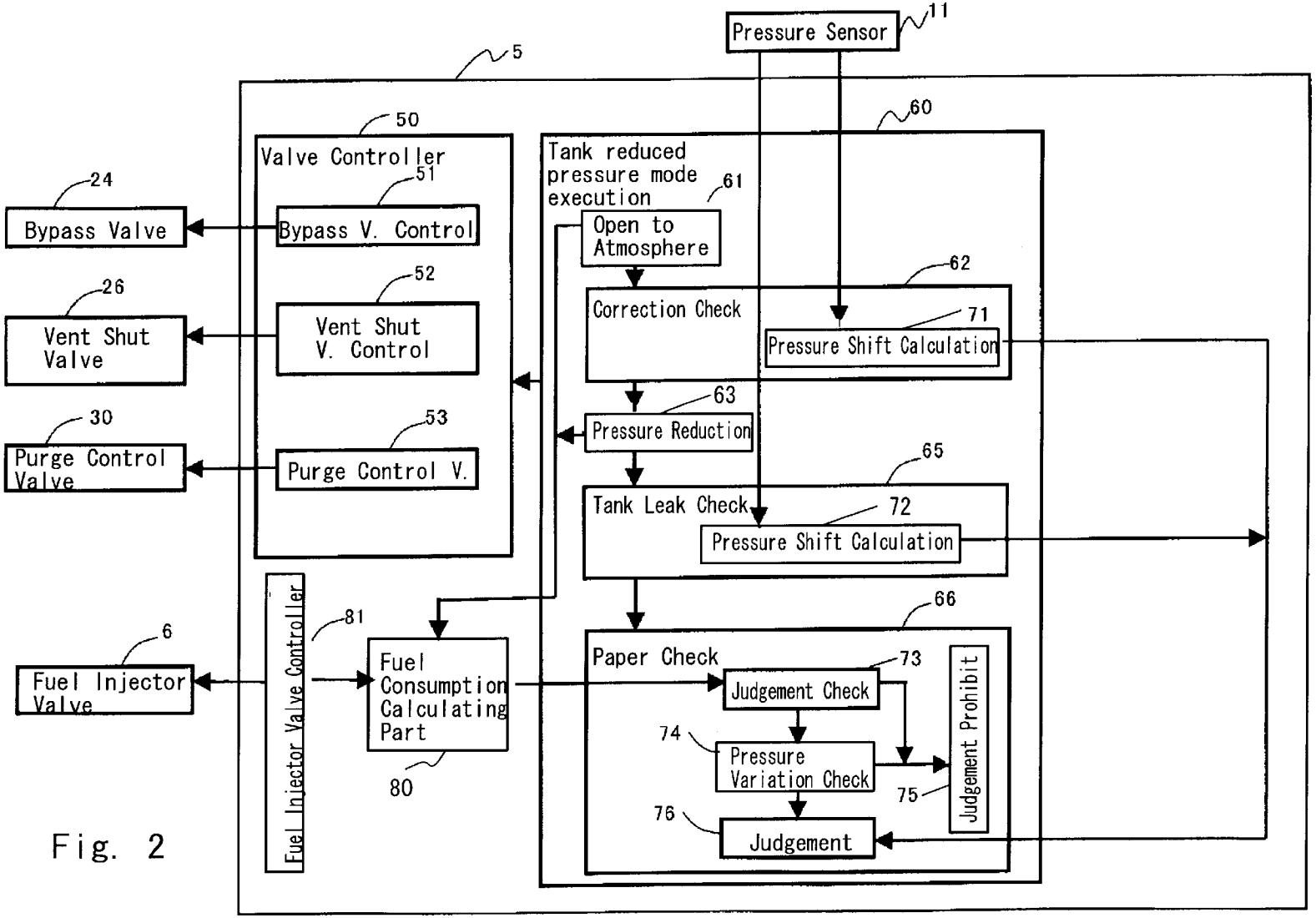
FIG. 2 is a functional block diagram of the ECU used in the present invention.

FIG. 2 shows the ECU 5 associated with this working configuration of the present invention in terms of functional blocks. These fractional blocks are implemented by means of the programs stored in the ROM 92 that run on the hardware construction of the ECU 5 shown in FIG. 1. The transfer of data by the functional blocks in the ECU 5 is accomplished mainly via the RAM 93 (FIG. 1). The ECU 5 includes a valve controller 50, a tank pressure reduction mode execution part 60, a fuel consumption calculating part 80, and a fuel injection valve controller 81.

The valve controller 50 includes a bypass valve controller 51, which controls the opening and closing of the bypass valve 24, a vent shut valve controller 52, which controls the opening and closing of the vent shut valve 236, and a purge control valve controller 53, which controls the amount of opening of the purge control valve 30. The valve controller 50 sends driving signals to the respective valves in accordance with control signals from the tank pressure reduction mode execution part 60.

The tank pressure reduction mode execution part 60 includes an opening-to-atmosphere part 61, a correction checking part 62, a pressure reduction part 63, a tank leak checking part 65, and a vapor checking part 66. This tank pressure reduction mode execution part 60 performs tank pressure reduction monitoring, which will be described later with reference to FIG. 4. The correction checking part 62 and tank leak checking part 65 respectively include pressure shift calculating parts 71 and 72. These pressure shift calculating parts 71 and 72 respectively calculate the amounts of pressure shift per unit time during the correction check and tank leak check on the basis of the pressure values detected by the internal pressure sensor 11. The calculated values are sent to the judgement part 76 of the vapor checking part 66.

On the basis of signals from various types of sensors (not shown in the figures), the fuel injection valve controller 81 sends injection signals to the fuel injection valves 6, and thus controls the opening time of the fuel injection valves 6. The opening time of the fuel injection valves 6 is sent to the fuel consumption calculating part 80. On the basis of a flag that is set to 1 by the opening-to-atmosphere part 61 upon the completion of the process performed by said part, the fuel consumption calculating part 80 detects that a correction check is currently being performed, and it calculates the amount of fuel consumption on the basis of the opening time of the fuel injection valves 6 received from the fuel injection valve controller 81. Furthermore, on the basis of a flag that is set to 1 by the pressure reduction part 63 upon the completion of the process performed by said part, the fuel consumption calculating part 80 detects that a tank leak check is being performed, and it calculates the amount of fuel consumption on the basis of the opening time of the fuel injection valves 6 received from the fuel injection valve controller 81. The respective calculated values are sent to the judgement execution checking part 73 of the vapor checking part 66.

The vapor checking part 66 includes a judgement execution checking part 73, a pressure variation checking part 74, a judgement prohibition part 75 and a judgement part 76. On the basis of the amount of fuel consumption during the correction check and the amount of fuel consumption during the tank leak check calculated by the fuel consumption calculating part 80, the judgement execution checking part 73 ascertains whether or not a judgement of the presence or absence of leakage in the tank system is to be performed. The pressure variation checking part 74 also ascertains whether or not a judgement of the presence or absence of leakage in the tank system is to be performed, depending on whether or not the tank pressure at the time that the tank leak checking part 65 completes its processing is a positive pressure. The judgement prohibition part 75 or the judgement part 76 operates in accordance with the judgement results obtained by the judgement execution checking part 73 and pressure variation checking part 74. The judgement prohibition part 75 prohibits any judgement from being made, while the judgement part 76 judges the presence or absence of leakage in the tank system on the basis of the amounts of pressure shift per unit time during the correction check and tank leak check calculated by the pressure shift calculating parts 71 and 72.

Figure 3:
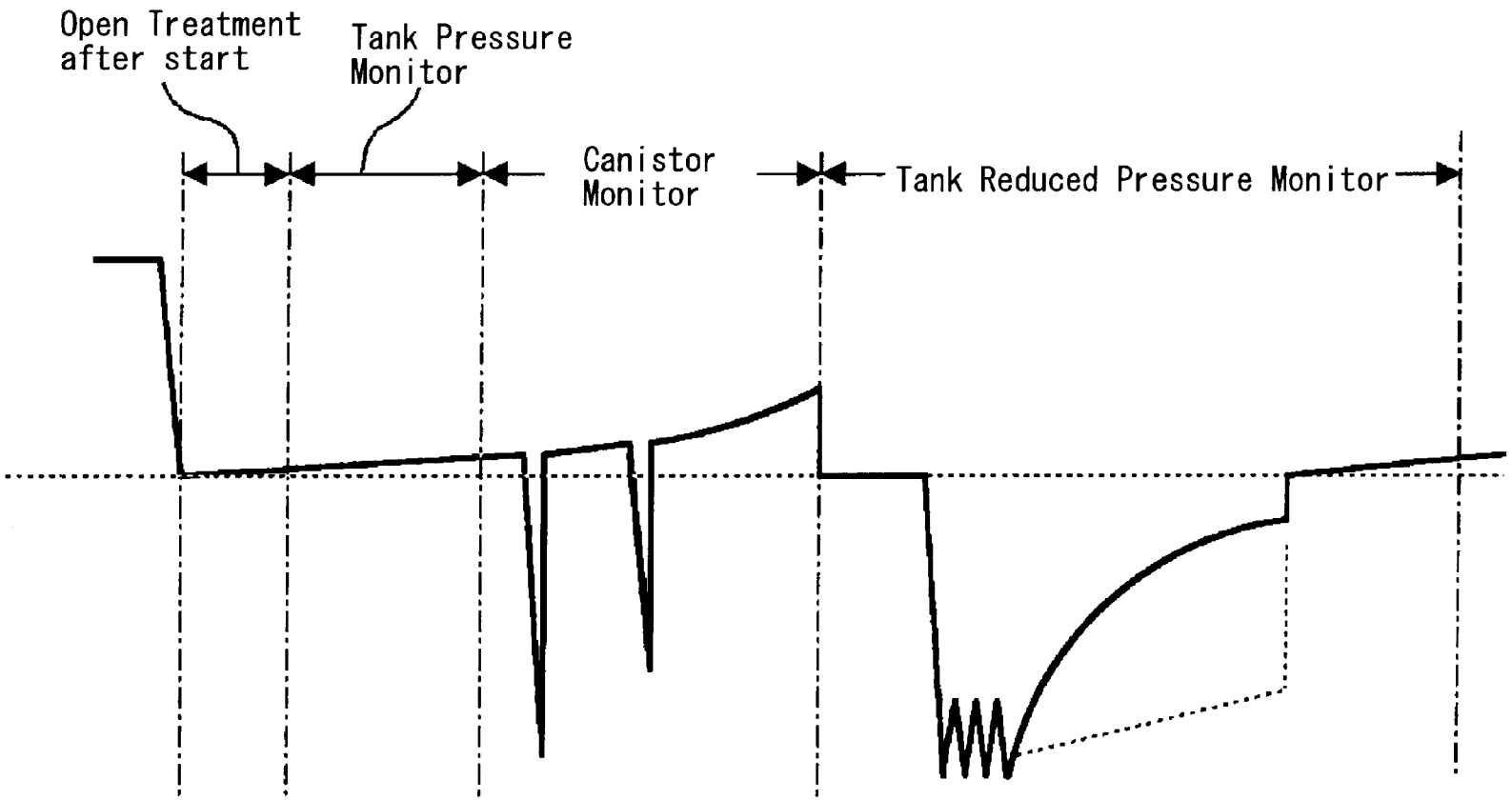
FIG. 3 is a graph which shows changes in the pressure during the judgement of the presence or absence of leakage in the discharge prevention system of the evaporated fuel treatment apparatus of the present invention.

Next, an outline of the judgement of the presence or absence of leakage in the discharge prevention system 31 will be described. FIG. 3 shows an example of the transition of the pressure in the tank system during the judgement of the presence or absence of leakage in one operating cycle of the engine from start to stop. The judgement process for the presence or absence of leakage has four stages, i.e., an opening treatment performed after starting, monitoring of the tank pressure, monitoring of the canister and monitoring of the tank pressure reduction. The monitoring of the tank pressure reduction will be described later with reference to FIG. 4 where an outline of the opening treatment performed after starting, the monitoring of the tank pressure and the monitoring of the canister, will be described.

Opening Treatment Following Starting, and Monitoring of Internal Pressure

In the opening treatment performed following starting, the bypass valve 24 and vent shut valve 26 are opened immediately after the engine is started, and the purge control valve 30 is closed, so that the pressure of the discharge prevention system 31 is opened to atmospheric pressure. In this case, if the tank pressure shifts from the value measured prior to the opening of the system to the atmosphere by an amount equal to or greater than a specified value, it is judged that the tank system is normal, with no leakage. This specified value is set at different values for holes with diameters of 0.5 and 1 mm. If leakage is present, the tank system prior to starting will be more or less at atmospheric pressure, so that the pressure shift is small.

Following the above-mentioned opening treatment that is performed after starting, monitoring of the tank pressure is performed. In this case, the output level of the internal pressure sensor 11 is continuously checked with the bypass valve 24 in a closed state, and in cases where this level shifts to a positive pressure or negative pressure by an amount equal to or greater than a specified value, it is judged that there is no leakage.

Canister Monitoring

Canister monitoring includes opening to the atmosphere, pressure reduction, waiting for internal pressure stabilization, leak checking and pressure recovery modes. In canister monitoring, the presence or absence of leakage is judged by placing the canister under a negative pressure, and detecting the conditions of maintenance of this negative pressure.

Tank Pressure Reduction Monitoring

Figure 4:
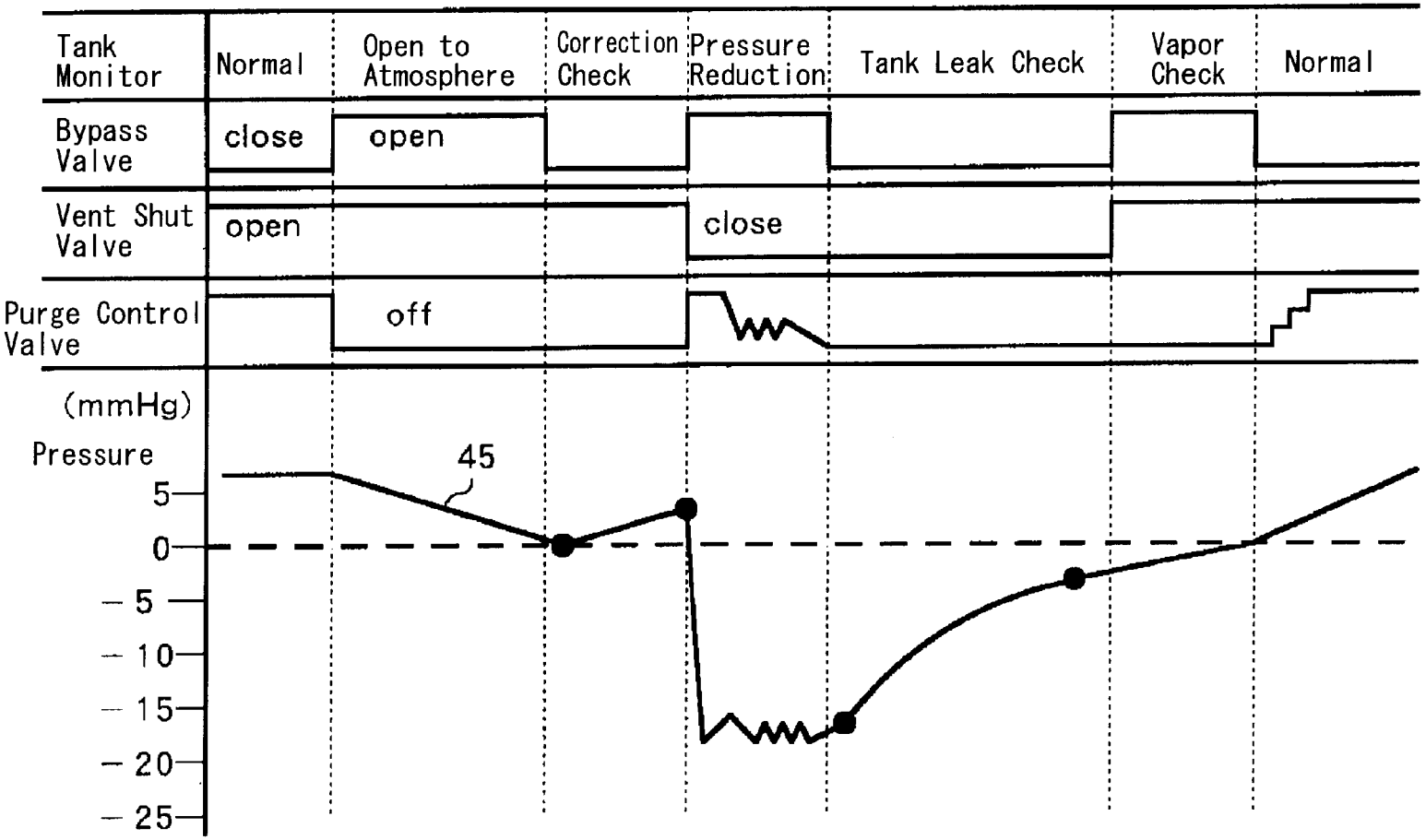
FIG. 4 is a graph which shows changes in the tank pressure during the judgement of leakage in the tank system in the tank pressure reduction monitoring portion in FIG. 3.

FIG. 4 is a diagram which shows in detail the tank pressure reduction monitoring portion of the process shown in FIG. 3. Tank pressure reduction monitoring is performed after the internal pressure monitoring, and can detect leakage not detected in the opening treatment performed following starting or the internal pressure monitoring. For example, in cases where the system was judged to be normal (without leakage) only with respect to leakage caused by holes with a diameter of 1 mm or greater in the opening treatment performed following starting or the internal pressure monitoring, the presence or absence of leakage caused by holes with a diameter of 0.5 mm can be judged by performing this tank pressure reduction monitoring. Furthermore, if it is judged in the opening treatment performed following starting and the internal pressure monitoring that the system is normal (with no leakage) according to both the 1 mm diameter criteria and the 0.5 mm diameter criteria, it is also possible to dispense with this tank pressure reduction monitoring.

The above-mentioned tank pressure reduction monitoring includes opening to the atmosphere, correction checking, pressure reduction, tank leak checking and vapor checking (pressure recovery) modes. The solid line 45 indicates the pressure value indicated by the internal pressure sensor 11. In the ordinary mode, only the bypass valve 24 is closed, and the vent shut valve 26 and purge control valve 30 are open.

Prior to the operation of the correction checking mode, the bypass valve 24 is opened and the purge control valve 30 is closed, so that there is a shift to the opening-to-the-atmosphere mode. The tank pressure varies toward atmospheric pressure as is shown by the solid line 45. The time required for the operation of the opening-to-the-atmosphere mode is (for example) 15 seconds.

When the tank pressure is at atmospheric pressure, the bypass valve 24 is closed, the vent shut valve 26 is opened, the purge control valve 30 is closed, and the processing shifts to the correction checking mode. Vapor is generated in the fuel tank 9, and the tank pressure rises depending on the amount of this vapor. Accordingly, this rise in pressure must be taken into account in the subsequent judgement of leakage in the tank system. In the correction checking mode, the amount of pressure shift per unit time involved in the rise from atmospheric pressure to a positive pressure is measured as a correction value. The time required for the operation of the correction checking mode is (for example) 30 seconds.

Next, the bypass valve 24 is opened, the vent shut valve 26 is closed, and the processing shifts to the pressure reduction mode. While the purge control valve is controlled, the tank pressure is stably reduced to a specified pressure, e.g., −15 mmHg. The internal pressure sensor 11 is installed in the narrow charging passage 20, which quickly shows a negative pressure. Since the volume of the fuel tank 9 is large in comparison, cases arise in which the pressure in the tank is not a negative pressure even though the sensor 11 indicates a negative pressure. Accordingly, in order to obtain a stable negative pressure state, feedback pressure reduction is performed following open pressure reduction.

In the open pressure reduction that is initially performed, an open pressure reduction target flow rate table is searched, the purge flow rate corresponding to the current tank pressure is calculated, the duty ratio corresponding to this purge flow rate is set, and the amount of opening of the purge control valve 30 is controlled accordingly. Afterward, the vent shut valve 26 is closed, and the bypass valve 24 and purge control valve 30 are opened, so that the pressure in the tank system is reduced. The pressure in the tank system is reduced to a certain pressure by continuing this pressure reduction for a specified period of time.

Feedback pressure reduction is performed after open pressure reduction has been performed. As a result of open pressure reduction, the tank pressure is closed to the lower-limit value of the pressure reduction target value; accordingly, the next pressure reduction target value is changed to the upper-limit value. The purging flow rate is reduced on the basis of the current tank pressure and the pressure reduction target value so that the tank pressure reaches the pressure reduction target value. The purge control valve 30 is set at the amount of valve opening that corresponds to the reduced purging flow rate. As a result, the tank pressure rises correspondingly. When the tank pressure sensor output reaches the upper-limit value, the reduced target value of the tank pressure is changed to the lower-limit value, and the purging flow rate is increased on the basis of the current tank pressure and the pressure reduction target value so that the tank pressure reaches the pressure reduction target value. The purge control valve 30 is set at the amount of valve opening that corresponds to the increased purging flow rate. As a result, the tank pressure shows a corresponding decrease. When the tank pressure sensor output reaches the lower-limit value, the pressure reduction target value of the tank pressure is changed to the upper-limit value.

When pressure recovery and pressure reduction are thus repeated while the purging flow rate is increased and decreased between the upper-limit value and lower-limit value of the pressure reduction target value, the purging flow rate adheres to the lower-limit value. Specifically, even if the purging flow rate is reduced, the tank pressure no longer rises to the target upper-limit value. Alternatively, the purging flow rate adheres to the upper-limit value, so that even if the purging flow rate is increased, the tank pressure no longer drops to the target lower-limit value. This indicates that the tank pressure is in a negative pressure state between the upper-limit value and the lower-limit value, and that a stable point which is such that the tank pressure does not vary even if the purging flow rate is varied has been reached; accordingly, when such a state is reached, the feedback pressure reduction is ended.

As a result of this pressure reduction, the differential pressure between the pressure indicated by the internal pressure sensor 11 and the actual tank pressure becomes virtually zero. The time required for this pressure reduction mode is (for example) 30 to 40 seconds.

After the tank system has reached a specified negative pressure state, all of the valves 24, 26 and 30 are closed, and the processing shifts to the tank leak checking mode. If there is no leakage in the tank system, the negative pressure is more or less maintained, so that the amount of pressure that is restored (this is due to the effects of vapor) is small. If there is leakage in the tank system, the amount of pressure that is restored is large. Since it is necessary to detect extremely small holes such as holes with a diameter of 0.5 mm, the time required for the tank leak checking mode is (for example) 30 seconds.

Next, the bypass valve 24 and vent shut valve 26 are opened, and the processing shifts to the vapor checking mode (pressure recovery mode), so that the tank system is returned to atmospheric pressure. Here, in cases where the tank pressure shifts toward atmospheric pressure from a positive pressure, this indicates that the tank pressure has shifted to a positive pressure as a result of vapor generation, etc., during the tank leak check, so that the accurate amount of pressure shift has not been calculated during the tank leak check; accordingly, judgement of the presence or absence of leakage is prohibited. Conversely, in cases where the tank pressure shifts to atmospheric pressure from a negative pressure, the presence of absence of leakage in the tank system is judged on the basis of a value obtained by subtracting (i) a value produced by multiplying the amount of pressure shift per unit time during the correction check by a coefficient, from (ii) the amount of pressure shift per unit time during the leak check. The time required for the vapor checking mode is (for example) 3 seconds.

Thus, in order to make a final judgement of the presence or absence of leakage in the tank system, it is necessary to make a correction for the pressure rise caused by the vapor in the fuel tank 9. However, if (for example) the vehicle is accelerated to a rapid speed during the tank leak checking mode so that a large amount of fuel is consumed, the rise in the fuel tank pressure will be small, so that even if there is a hole in the fuel tank, the tank system may be judged as normal, i.e., free of leakage. Furthermore, a tank leak checking mode which requires considerable time (30 to 60 seconds) is necessary in order to detect leakage caused by extremely small holes such as holes with a diameter of 0.5 mm. Accordingly, driving conditions may differ during the correction check and tank leak check, so that the correction is inappropriate, leading to an erroneous judgement.

In the disclosed embodiments of the present invention, the amounts of fuel consumption indicating the driving conditions during the correction checking mode and tank leak checking mode are calculated, and the question of whether or not a judgement of the presence or absence of leakage in the tank system should be performed is decided on the basis of these values.

Calculation of Fuel Consumption

Figure 5:
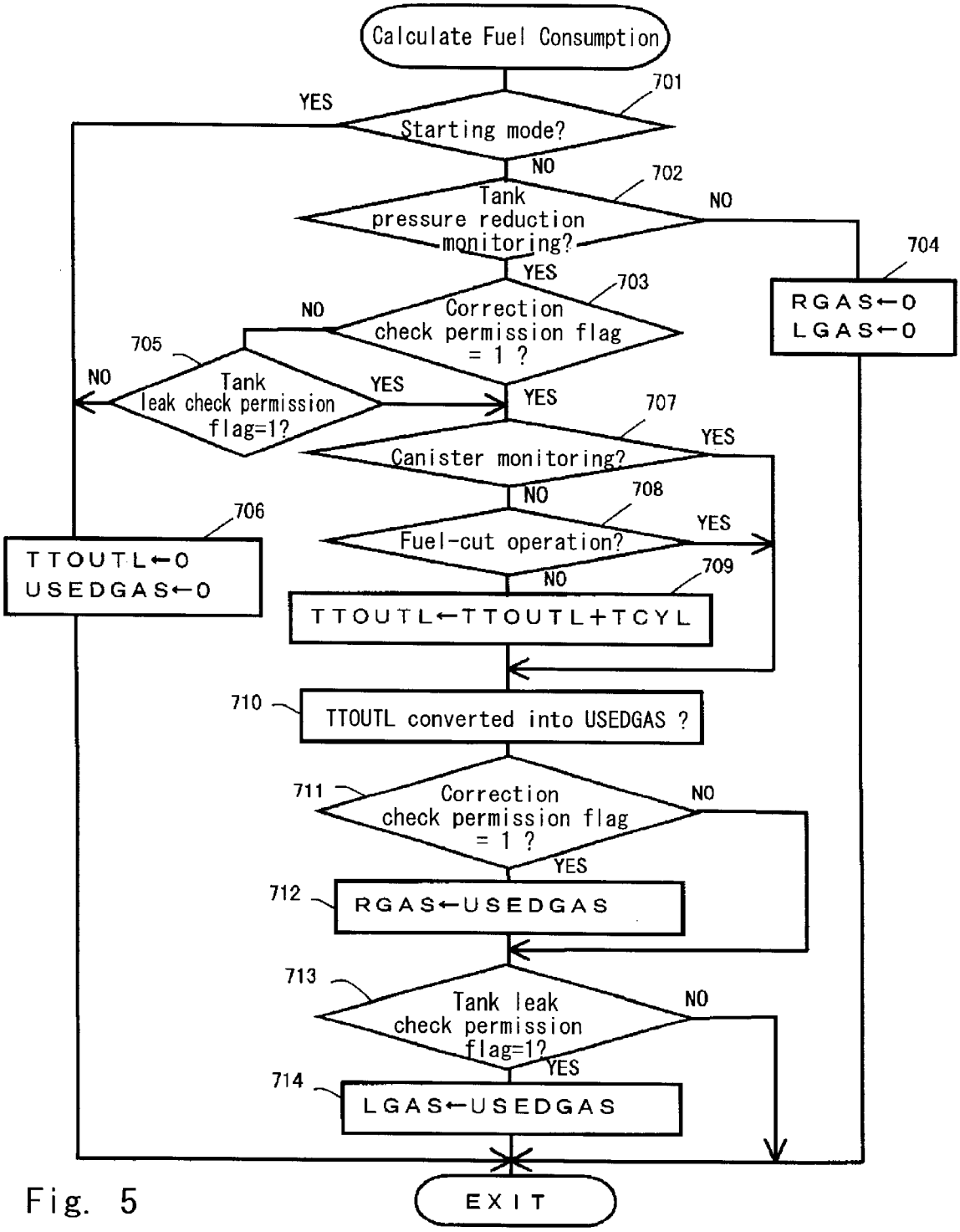
FIG. 5 is a flow chart which shows the calculation of the amounts of fuel consumption in the correction checking mode and tank leak checking mode.

FIG. 5 is a flow chart which shows the process for calculating the amount of fuel consumption in the correction checking mode and tank leak checking mode. This process is performed by the fuel consumption calculating part 8 shown in FIG. 2. This process can be appropriately performed in the background of the process performed in tank pressure reduction monitoring.

In step 701, a judgement is made as to whether or not the vehicle is in starting mode. If the vehicle is in starting mode, the processing advances to step 706, and the total fuel injection time TTOUTL and amount of fuel consumption USEDGAS are respectively initialized to zero. If the vehicle is not in starting mode, the fuel consumption amount calculation process is initiated.

In step 702, a judgement is made as to whether or not the system is currently engaged in tank pressure reduction monitoring. If the system is currently engaged in tank pressure reduction monitoring, the process advances to step 704, and the amount of fuel consumption RGAS during the correction check, and the amount of fuel consumption LGAS during the tank leak check, which are to be calculated, are respectively initialized to zero. If the system is engaged in tank pressure reduction monitoring, a judgement is made in step 703 as to whether or not the system is currently engaged in a correction check, this judgement being made on the basis of a correction check permission flag, which is set to 1 if the system is engaged in a correction check. If the system is not currently engaged in a correction check, a judgement is made in step 705 as to whether or not the system is currently engaged in a tank leak check, this judgement being made on the basis of a tank leak check permission flag, which is set to 1 if the system is engaged in a tank leak check. If the system is not currently engaged in either a correction check or a tank leak check, the process advances to step 706, and the total fuel injection time TTOUTL and amount of fuel consumption USEDGAS are respectively initialized to zero.

If the system is currently engaged in a correction check or tank leak check, the process advances to step 707. If the system is not currently engaged in canister monitoring, the process advances to step 708; furthermore, if the system is not in fuel cut mode, in which no fuel is supplied to the engine, the process advances to step 709. If the system is currently engaged in canister monitoring or fuel cut mode, the process skips to step 710, since the above modes have no relation to the fuel consumption involved here.

In step 709, the fuel injection time TCYL is added to the total fuel injection time TTOUTL. Here, the fuel injection time TCYL is the valve opening time of each fuel injection valve 6 controlled by the fuel injection valve controller 81 shown in FIG. 2. This time is sent from the fuel injection valve controller 81 to the fuel consumption calculating part 80. The process shown in FIG. 5 is repeatedly performed, say every 80 milliseconds; accordingly, the fuel injection time during the correction check or tank leak check is totaled as TTOUTL in step 709.

The process advances to step 710, and the total fuel injection time TTOUTL calculated in step 709 is converted into the amount of fuel consumption USEDGAS. This conversion is performed according to formula (1) shown below. Here, the injection time per 0.1 cc is a predetermined value.

$$USEDGAS = TTOUTL / \text{injection time per 0.1 cc of fuel} \quad \text{(Formula 1)}$$

The process advances to step 711, and a judgement is made on the basis of the correction check permission flag as to whether or not the system is still currently engaged in a correction check. If the system is engaged in a correction check, the process advances to step 712, and the amount of fuel consumption USEDGAS calculated in step 710 is set as the correction check fuel consumption amount RGAS; this RGAS is stored in the RAM 93. The process then advances to step 713, and a judgement is made on the basis of the tank leak check permission flag as to whether or not the system is still currently engaged in a tank leak check. If the system is engaged in a tank leak check, the process advances to step 714, and the amount of fuel consumption USEDGAS calculated in step 710 is set as the tank leak check fuel consumption amount LGAS; this LGAS is stored in the RAM 93. The stored RGAS and LGAS are used in the vapor checking mode.

The programs used to perform the process shown in the flow charts for the correction check, tank leak check and vapor check described below are part of the programs that perform the tank pressure reduction monitoring process that is invoked, for example, every 80 milliseconds.

Correction Checking Mode

Figure 6:
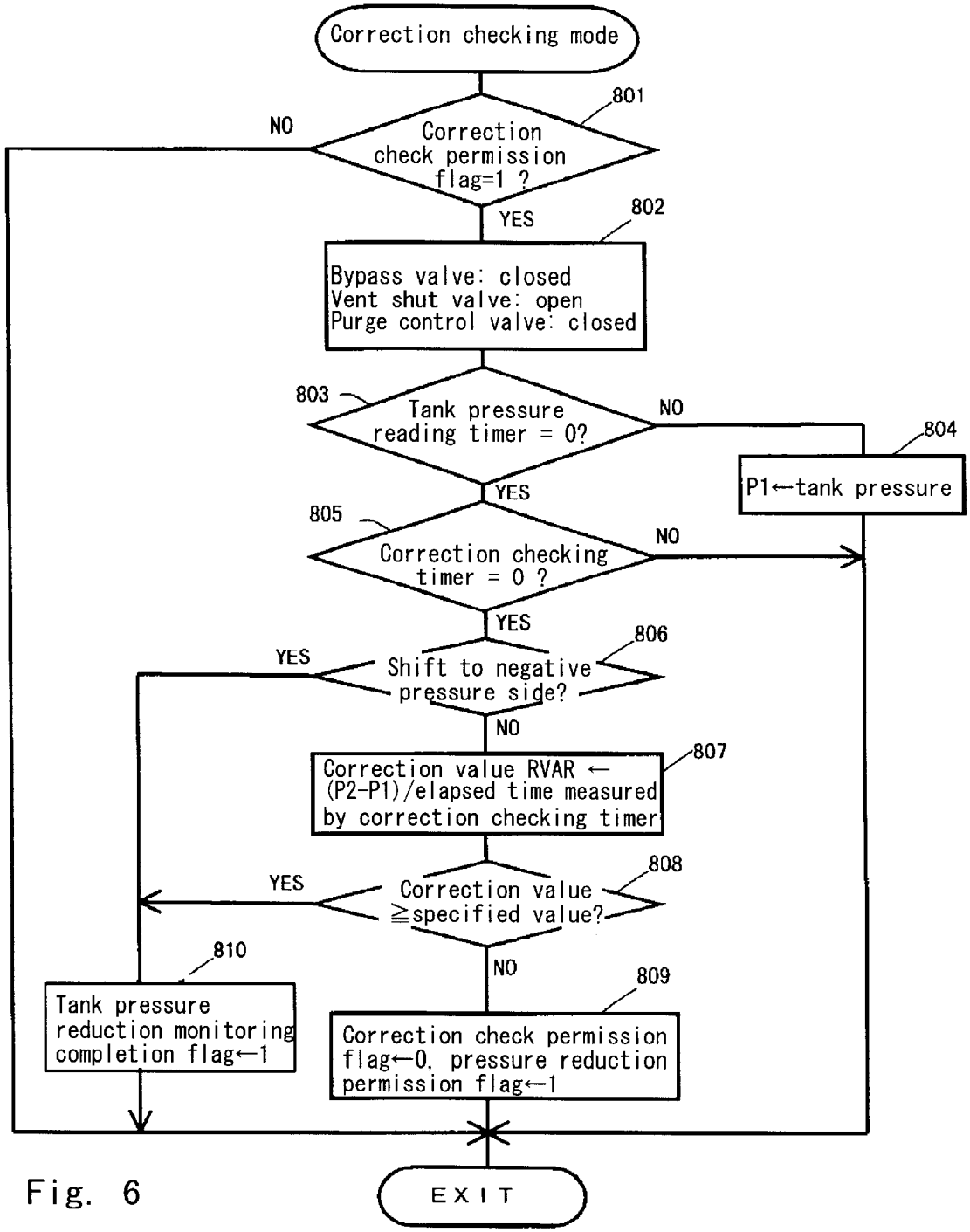
FIG. 6 is a flow chart which shows the calculation of the amount of pressure shift per unit time in the correction checking mode.

FIG. 6 is a flow chart showing the calculation of the correction value in the correction checking mode. This process is performed by the correction checking part 62 and associated pressure shift calculating part 71 shown in FIG. 2. If the correction check permission flag that is set by the opening-to-atmosphere part 61 (FIG. 2) upon the completion of the processing of the opening-to-atmosphere mode is 1 in step 801, the process advances to step 802, and the correction checking process is initiated. In step 802, the bypass valve 24 and purge control valve 30 are closed, and the vent shut valve 26 is opened.

The process advances to step 803, and if the tank pressure reading timer is not at zero, the process advances to step 804; here, the output of the internal pressure sensor 11 is detected, and is stored in the RAM 93 as the initial value P1 of the tank pressure. The reason for the installation of an tank pressure reading timer is to read the tank pressure when the pressure has become settled to some extent following the passage of a specified amount of time, since the tank pressure shifts when the bypass valve 24 is closed from an open state.

If the tank pressure reading time is at zero in step 803, i.e., if a specified amount of time has elapsed, the process proceeds to step 805, and a judgement is made as to whether or not the correction checking mode timer is at zero. The correction checking mode timer is used in order to ascertain whether or not the time required fort the calculation of the correction value has elapsed; this timer is set at a larger value than the above-mentioned tank pressure reading time. If the correction checking mode timer is at zero, the process proceeds to step 806.

In step 806, the current tank pressure P2 and the initial value P1 of the tank pressure stored in step 804 are compared, and a judgement is made as to whether or not the tank pressure has shifted toward the negative pressure side by a specified value or greater. If this pressure shifts toward the negative pressure side, this indicates that the evaporated fuel is in a liquefied state as a result of a drop in the temperature inside the fuel tank, so that an appropriate correction value cannot be obtained. Accordingly, the process proceeds to step 810, the tank pressure reduction monitoring completion flag is set to 1, and tank pressure reduction monitoring in this operating cycle is prohibited.

If there is no shift to the negative pressure side in step 806, the process proceeds to step 807, and a correction value RVAR indicating the amount of shift in the tank pressure per unit time is calculated according to the formula shown below.

Correction value RVAR=(P2−P1)/elapsed time measured by correction checking timer (Formula 2)

The process proceeds to step 808. Here, if the calculated correction value RVAR is equal to or greater than a specified value, there is a possibility that the tank pressure will adhere to the positive pressure side control pressure of the two-way valve 23 as a result of the generation of large amounts of vapor. The value calculated in such a state is not an appropriate correction value; accordingly, the process proceeds to step 810, the tank pressure reduction monitoring completion flag is set to 1, and tank pressure reduction monitoring is prohibited. If the correction value RVAR is smaller than the above-mentioned specified value, the process proceeds to step 809, the correction check permission flag is set at zero, and the pressure reduction permission flag is set to 1 in order to perform the next pressure reduction mode processing. The correction value RVAR thus obtained is stored in the RAM 93 and is used in the vapor checking mode.

Tank Leak Checking Mode

Figure 7:
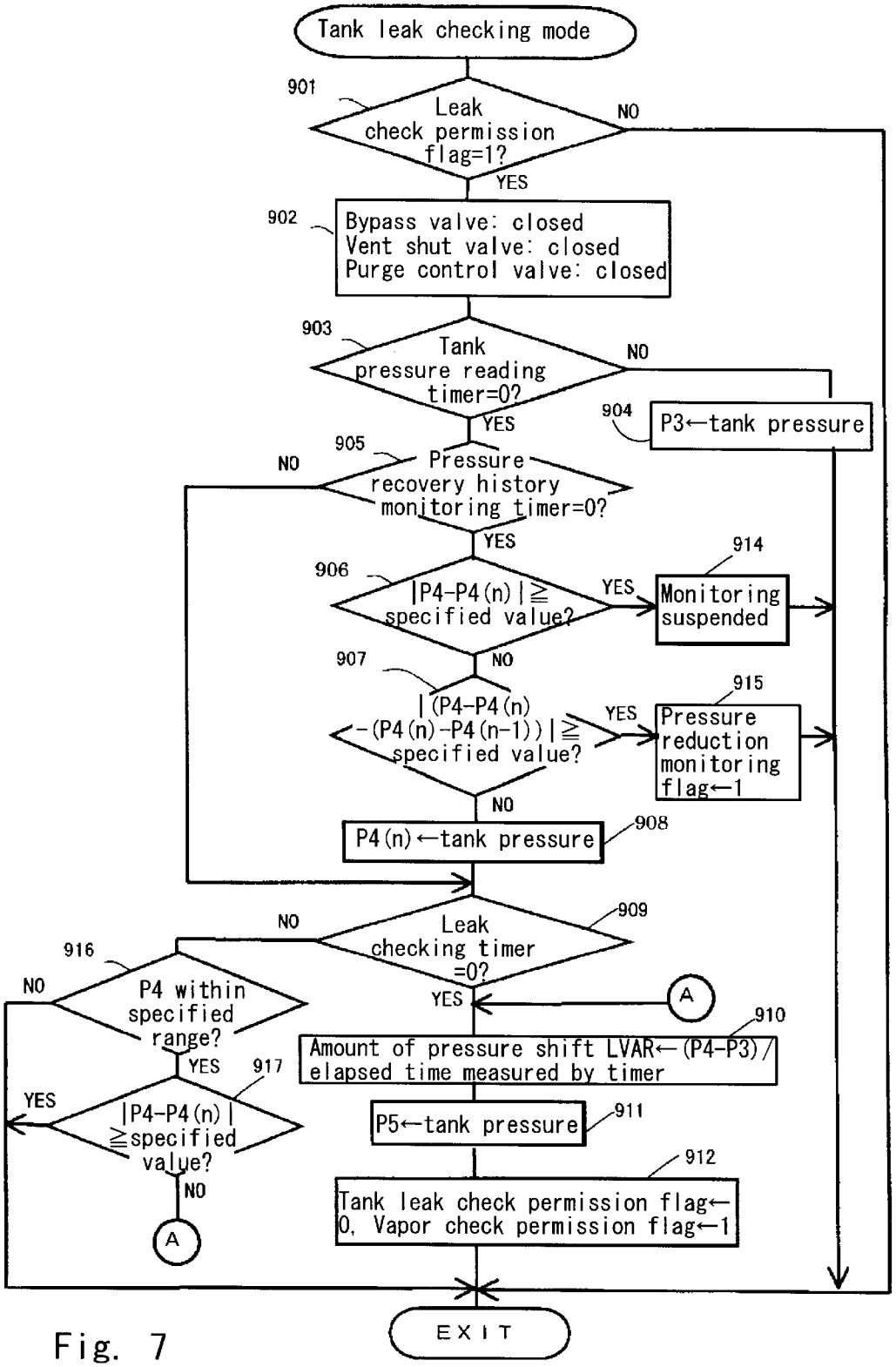
FIG. 7 is a flow chart which shows the calculation of the amount of pressure shift per unit time in the tank leak checking mode.

FIG. 7 is a flow chart showing the calculation of the amount of pressure shift per unit time when the interior of the fuel tank is placed under a negative pressure in the tank leak checking mode. This calculation is performed by the tank leak checking part 65 and associated pressure shift calculating part 72 shown in FIG. 2. If the tank leak check permission flag, which is set to 1 by the pressure reduction mode part 63 (FIG. 2) upon the completion of the pressure reduction mode processing, is 1 in step 901, the processing proceeds to step 902, and the tank leak checking process is initiated.

In step 902, the bypass valve 24, vent shut valve 26, and purge control valve 30 are all closed. The processing proceeds to step 903, and a judgement is made as to whether or not the tank pressure reading time is at zero. If the tank pressure reading timer is not at zero, the processing proceeds to step 904, and the value detected by the internal pressure sensor II is stored in the RAM 93 as the initial value P3 of the tank pressure. As in the case of the correction checking mode, the reason for the installation of the tank pressure reading timer is to read the tank pressure after the pressure has become settled to some extent following the passage of a specified amount of time.

It the tank pressure reading timer is at zero in step 903, the process proceeds to step 905, and a judgement is made as to whether or not the pressure recovery history monitoring timer is at zero. If this timer is at zero, pressure recovery history monitoring (steps 906 to 908) is performed. This pressure recovery history monitoring is performed at specified time intervals during the processing of the tank leak checking mode; each time, the tank pressure is read in step 908 and stored in the RAM 93 in a time series (i.e., this is stored with the previous tank pressure as P4(n) and the tank pressure before that as P4(n−1), etc.), so that the amount of pressure shift is monitored.

In step 906, if the absolute value of the difference between the current tank pressure P4 and the previous tank pressure P4(n) is equal to or greater than a predetermined value, this is judged to be an abrupt change in pressure caused by oscillation of the liquid level, etc., so that an appropriate amount of pressure shift cannot be calculated. Accordingly, tank pressure reduction monitoring is suspended, and the pressure is restored so that the processing returns to the ordinary mode. Here, the reason that the monitoring is suspended rather than being prohibited is that although there was an abrupt pressure shift in the current tank leak check, such a pressure variation may not occur in the next tank leak check.

The process proceeds to step 907, and the difference P4−P4(n) between the current tank pressure P4 and the previous tank pressure P4(n) (this is designated as ΔPx), and the difference P4(n)−P4(n−1) between the previous tank pressure P4(n) and the tank pressure P4(n−1) preceding the previous tank pressure P4(n) (this is designated as ΔPy), are calculated. If the absolute value |ΔPx−ΔPy| of the difference between ΔPx and ΔPy is equal to or greater than a predetermined value, it is judged that the fuel tank is in full-tank cut-off valve operation. Since an appropriate amount of pressure shift cannot be calculated in such a state, the process proceeds to step 915, the tank pressure reduction monitoring completion flag is set to 1, and tank pressure reduction monitoring for this operating cycle is prohibited.

After the above-mentioned pressure recovery history monitoring has been completed, the process proceeds to step 909, and a judgement is made as to whether or not the tank leak checking timer is at zero. If this timer is at zero, the process proceeds to step 910, and the amount of pressure shift per unit time (LVAR) in the tank leak checking mode is calculated according to the formula shown below on the basis of the current tank pressure P4 and the initial value P3 of the tank pressure stored in step 904. This calculated LVAR is stored in the RAM 93, and is used in the vapor checking mode.

Amount of pressure shift per unit time LVAR=(P4−P3)/elapsed time measured by tank leak checking timer (Formula 3)

The process proceeds to step 911, and the pressure value detected by the internal pressure sensor 11 is stored in the RAM 93 as the tank pressure PS at the time of completion of the tank leak check. This value is used in the subsequent vapor checking mode. The process proceeds to step 912, the tank leak check permission flag is set at zero, and the vapor check permission flag is set to 1 in order to perform the subsequent processing in the vapor checking mode.

If the tank leak checking timer is not at zero in step 909, the process proceeds to step 916, and a judgement is made as to whether or not the current tank pressure P4 is within a specified range in the vicinity of atmospheric pressure. If the current tank pressure P4 is within this specified range, the process proceeds to step 917, and a judgement is made as to whether or not the absolute value |P4−P4(n)| of the difference between the current tank pressure P4 and the previous tank pressure P4(n) is equal to or greater than a predetermined value. If the absolute value of the difference is smaller than this predetermined value, this indicates that the pressure has become more or less settled, so that there is no need to wait for the passage of time as measured by the tank leak checking timer. Accordingly, the process proceeds to step 910, and the amount of pressure shift per unit time is calculated. The calculation in this case is performed using the following formula:

Amount of pressure shift per unit time LVAR=(P4−P4(n)/time from the starting of the tank leak checking timer to the judgement made in step 917. (Formula 4)

Vapor Checking Mode

Figure 8:
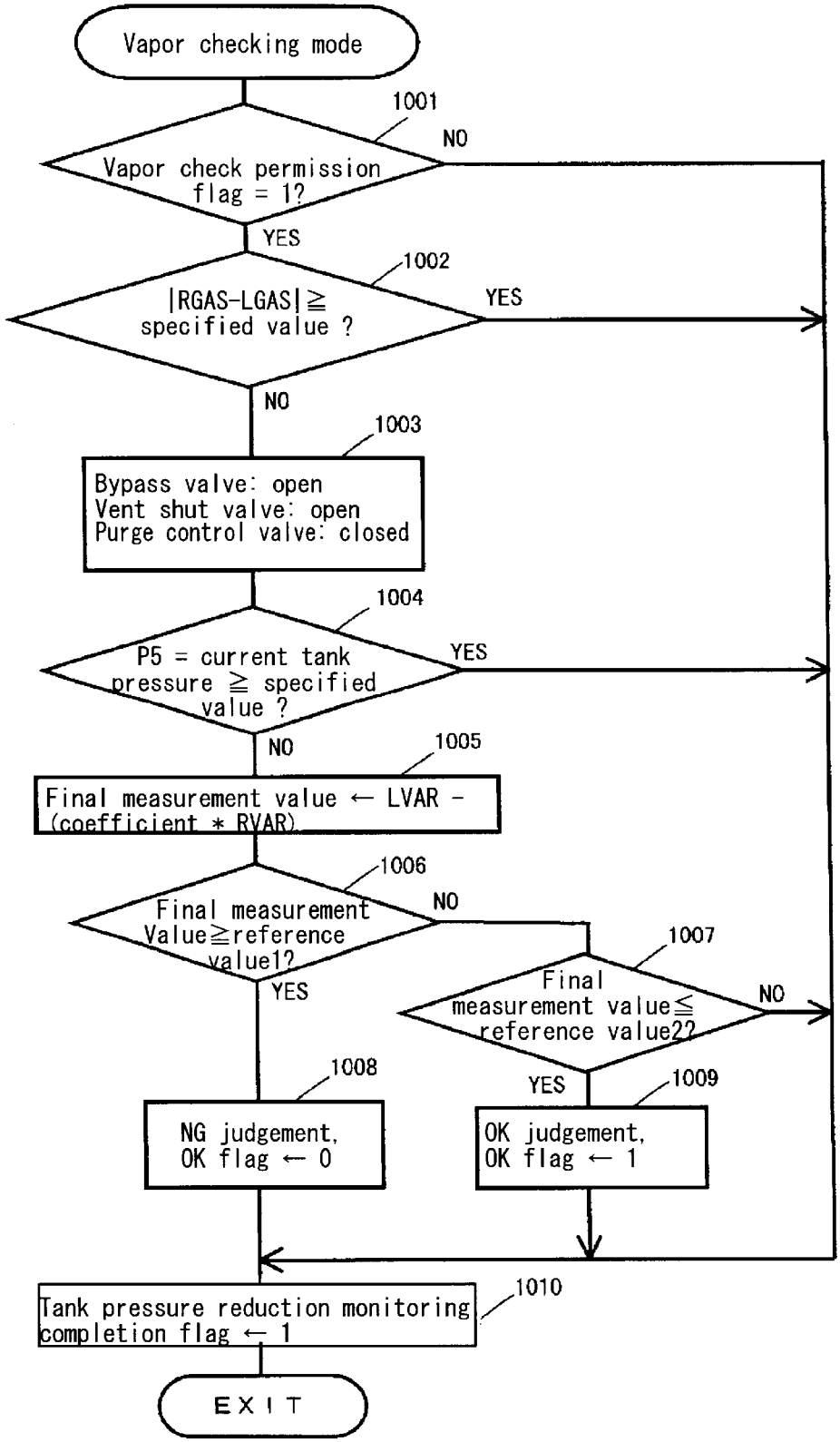
FIG. 8 is a flow chart which shows the judgement of the presence or absence of leakage in the tank system in the vapor checking mode.

FIG. 8 is a flow chart that shows the judgement of the status of the tank pressure upon the completion of the tank leak checking mode, and the judgement of the presence or absence of leakage in the tank system, in the vapor checking mode. This process is performed by the vapor checking part 66 shown in FIG. 2, the judgement execution checking part 73 contained in the vapor checking part 66, the pressure variation checking part 74, the judgement prohibition part 75, and the judgement part 76. If the vapor check permission flag, which is set upon the completion of the tank leak check processing, is 1 in step 1001, the process proceeds to step 1002, and the vapor checking process is initiated.

In step 1002, a judgement is made as to whether or not the absolute value of the difference between the correction check fuel consumption amount RGAS obtained in step 712 (FIG. 5) and the tank leak check fuel consumption amount LGAS obtained in step 714 is equal to or greater than a specified value (e.g., 10 cc). If the absolute value of this difference is equal to or greater than this specified value, then it is judged that an accurate judgement cannot be made, since the operating states for the two modes differ greatly. Accordingly, the process proceeds to step 1010, the tank pressure reduction monitoring completion flag is set to 1, and tank pressure reduction monitoring for this operating cycle is prohibited. As a result, no judgement of the presence or absence of leakage in the tank system is performed. In regard to the above-mentioned specified value, data indicating the effects of different operating states in the correction checking mode and leak checking mode on the detection of leakage caused by very small holes is accumulated by experiment and simulation, and the above-mentioned specified value is determined on the basis of the results obtained.

In the present working configuration, the amount of fuel consumption RGAS is the total amount of fuel consumption throughout the entire period of processing in the correction checking mode, and the amount of fuel consumption LGAS is the total amount of fuel consumption throughout the entire period of processing in the tank leak checking mode. These respective total amounts of fuel consumption are compared (step 1002); accordingly, specified values corresponding to the measurement time of the respective amounts of fuel consumption are used. Alternatively, the respective amounts of fuel consumption per unit time for the correction checking mode and tank leak checking mode may be calculated, and a comparison may be performed using specified values corresponding to these respective amounts of fuel consumption.

In step 1002, if the absolute value of the difference between RGAS and LGAS is smaller than the value determined as described above, the process proceeds to step 1003. Here, the bypass valve 24 and vent shut valve 26 are opened, and the purge control valve is closed, so that the tank system is opened to atmospheric pressure. The process then proceeds to step 1004. Here, the current tank pressure and the tank pressure P5 measured upon the completion of the tank leak check, which was stored in step 911 of the tank leak check (FIG. 7), are compared, and a judgement is made as to whether or not the tank pressure has dropped toward atmospheric pressure from a positive pressure. In other words, a judgement is made as to whether or not the tank pressure was a positive pressure.

If the tank pressure has dropped from a positive pressure toward atmospheric pressure by an amount that is equal to or greater than a specified value (e.g., 1.0 mmHg), this indicates that large amounts of vapor were generated so that the tank pressure shifted to a positive pressure at the time of completion of the tank leak checking mode, thus making it impossible to make an accurate judgement. Accordingly, the process proceeds to step 1010, the tank pressure reduction monitoring completion flag is set to 1, and monitoring is thus prohibited so that no judgement of leakage in the tank system is made. If the tank pressure has not dropped from a positive pressure to atmospheric pressure by an amount equal to or greater than the above-mentioned specified value, the process proceeds to step 1005, and the final measurement value used to make a judgement is calculated using the following formula:

Final measurement value=LVAR−(correction coefficient*RVAR) (Formula 5)

Here, LVAR is the amount of pressure shift per unit time during the tank leak check obtained in step 910 (FIG. 7), and RVAR is the amount of pressure shift per unit time during the correction check obtained in step 807 (FIG. 6). The conditions are different between the pressure rise from atmospheric pressure in the correction checking mode and the pressure rise from a negative pressure in the tank leak checking mode. The correction coefficient is employed to make up for such difference in conditions. For example, it is in the range of 1.5 to 2.0.

The process proceeds to step 1006. Here, if the calculated final measurement value is equal to or greater than reference value 1 (e.g., 8 mmHg), it would appear that the pressure rise in the tank leak checking mode is caused by leakage in the tank system. Accordingly, the process proceeds to step 1008, and a judgement of "abnormal" with leakage in the tank system is made judgment of NG); consequently, the OK flag is set at "0". If the calculated final measurement value is smaller than judgment value 1, the process proceeds to step 1007. In step 1007, if the calculated final measurement value is equal to or less than reference value 2 (e.g., 3 mmHg), it would appear that the pressure rise in the tank leak checking mode is caused by the generation of vapor. Accordingly, the process proceeds to step 1009, and a judgement of "normal" with no tank leakage (judgement of OK) is made; consequently, the OK flag is set at "1".

In step 1007, if the final measurement value is larger than reference value 2, i.e., if the final measurement value is larger than reference value 2 but smaller than reference value 1, this means that the presence or absence of leakage cannot be accurately judged. Accordingly, the process proceeds to step 1010, the tank pressure reduction monitoring completion flag is set to 1, and tank pressure reduction monitoring is prohibited. These relationships are shown in the table below.

TABLE 1

| | |
|---|---|
| Final measurement value ≧ reference value 1 | NG |
| Final measurement value ≦ reference value 2 | OK |
| Reference value 2 < final measurement value < reference value 1 | No judgement made |

Thus, it has been shown that the disclosed embodiments of the present invention make it possible to enhance the reliability of judgements on the presence or absence of leakage in the tank system.

What we claim is:

1. An evaporated fuel treatment apparatus for an internal combustion engine having a fuel tank, a canister having an opening to the atmosphere, the opening being opened or closed by a vent shut valve, a passage allowing the fuel tank to communicate with the canister, a purging passage allowing the canister to communicate with the intake manifold of the engine, the intake manifold having a reduced pressure as the engine intakes air, and a pressure sensor for detecting the internal pressure of the fuel tank, said apparatus comprising:

correction detecting means for detecting the rate of change in the internal pressure of the fuel tank when the fuel tank is closed after being placed in the atmospheric pressure;

leakage detecting means for detecting the rate of change in the internal pressure of the fuel tank when the fuel tank is closed after being placed in a negative pressure;

judgement means for judging the presence or absence of leakage in the fuel tank on the basis of the detection results by the leakage checking means and the correction checking means;

calculating means for calculating the amount of fuel consumption at the time of detection by the correction checking means and the amount of fuel consumption at the time of detection by the leakage checking means; and judgement prohibiting means for prohibiting a judgement of presence or absence of leakage from being made by the judgement means in cases where the amounts of fuel consumption calculated at the time of correction checking and at the time of leakage checking are substantially different from each other.

2. A system for detecting vapor leaks, comprising:

a detection system configured to detect vapor leaks of a predetermined diameter in a liquid storage system, the detection system comprising a liquid removal monitoring system coupled to the processor and configured to monitor the removal of liquid from the tank and to provide liquid removal information to the processor;

a processor coupled to the detection system and configured to determine the rate of removal of liquid from the tank and to restrict the detection system from detecting vapor leaks when the rate of liquid removal from the tank meets a predetermined threshold rate; and a correction detection system configured to detect the rate of change of vapor pressure in the tank, and wherein the processor is configured to determined the difference between the rate of liquid removal during a period of time when the correction detection system is in a correction detection mode and the rate of liquid removal during a period of time when the detection system is in a leak detection mode, and to compare the difference to a predetermined value.

3. The system of claim 2 wherein the processor is configured to prohibit leak detection when the difference is equal to or greater than the predetermined value.

4. A fuel distribution pipe in a fuel injection apparatus which increase a pressure of a fuel within a fuel source by a fuel pump to supply to the fuel distribution pipe and inject and supply the fuel to an engine via a fuel injection valve attached to the fuel distribution pipe, characterized that the fuel distribution path is pierced along a line X—X in a direction of a longitudinal axis of the fuel distribution pipe and an injection valve supporting hole for inserting and supporting a rear end portion of the fuel injection valve and a fuel introduction path for supplying a fuel having a pressure increased by a fuel pump are continuously provided in said fuel distribution path of the fuel distribution pipe, and that a cooling water flow path extending along the line X—X in the direction of the longitudinal axis of the fuel distribution path and sectioned from the fuel distribution path is provided on an outer periphery of said fuel distribution path, thereby introducing a cooling water into said cooling water flow path;

wherein the fuel distribution path disposed along the line X—X in the direction of the longitudinal axis within the fuel distribution pipe is formed so as to be sectioned from the cooling water flow path by forming the fuel distribution path and the cooling water flow path in said fuel distribution pipe by a drawing process along the line X—X in the direction of the longitudinal axis and closing the fuel distribution path and the cooling water flow path respectively open to one end portion and another end portion of the fuel distribution pipe by one side closing member and another side closing member;

wherein the fuel introduction path connected to the fuel distribution path and the cooling water introduction path and the cooling water discharge path connected to the cooling water flow path are provided in said one side closing member.

5. A fuel distribution pipe in a fuel injection apparatus which increase a pressure of a fuel within a fuel source by a fuel pump to supply to the fuel distribution pipe and inject and supply the fuel to an engine via a fuel injection valve attached to the fuel distribution pipe, characterized that the fuel distribution path is pierced along a line X—X in a direction of a longitudinal axis of the fuel distribution pipe and an injection valve supporting hole for inserting and supporting a rear end portion of the fuel injection valve and a fuel introduction path for supplying a fuel having a pressure increased by a fuel pump are continuously provided in said fuel distribution path of the fuel distribution pipe, and that a cooling water flow path extending along the line X—X in the direction of the longitudinal axis of the fuel distribution path and sectioned from the fuel distribution path is provided on an outer periphery of said fuel distribution path, thereby introducing a cooling water into said cooling water flow path;

wherein the fuel distribution path disposed along the line X—X in the direction of the longitudinal axis within the fuel distribution pipe is formed so as to be sectioned from the cooling water flow path by forming the fuel distribution path and the cooling water flow path in said fuel distribution pipe by a drawing process along the line X—X in the direction of the longitudinal axis and closing the fuel distribution path and the cooling water flow path respectively open to one end portion and another end portion of the fuel distribution pipe by one side closing member and another side closing member;

wherein the fuel introduction path connected to the fuel distribution path and the cooling water introduction path connected to the cooling water flow path are provided in said one side closing member, and the cooling water discharge path connected to the cooling water flow path is provided in said another side closing member.

6. The system of claim 4 wherein the predetermined value corresponds to a rise in vapor pressure generated from vapor in the tank.

7. A method for detecting fuel vapor leaks in a fuel tank system, comprising:

monitoring the pressure of fuel vapors in the fuel tank system for fuel vapor leaks, comprising a leak detection monitoring mode that comprises monitoring the pressure of fuel vapors in the fuel tank system for fuel vapor leaks of a predetermined size and a correction detection mode comprising detecting the rate of change of fuel vapor pressure in the fuel tank system; and determining the rate of fuel consumption, comprising determining a first rate of fuel consumption during leak detection mode and determining a second rate of fuel consumption during correction detection mode; comparing the difference between the first rate of fuel consumption and the second rate of fuel consumption to a predetermined value; and prohibiting further monitoring when the difference between the first rate of fuel consumption and the second rate of fuel consumption meets the predetermined threshold value.

8. A method for detecting fuel vapor leaks in a fuel tank system, comprising: monitoring the pressure of fuel vapors in the fuel tank system for fuel vapor leaks, comprising a leak detection monitoring mode that comprises monitoring the pressure of fuel vapors in the fuel tank system for fuel vapor leaks of a predetermined size and a correction detection mode comprising detecting the rate of change of fuel vapor pressure in the fuel tank system; determining the rate of fuel consumption; and wherein determining the rate of fuel consumption comprises separately determining a first rate of fuel consumption during leak detection mode and a second rate of fuel consumption during correction detection mode and comparing the first and second rates of fuel consumption to first and second predetermined rates; and further wherein restricting monitoring of the fuel vapor pressure comprises restricting monitoring of the fuel vapor pressure when the comparison of either one of the first and second fuel consumption rates to the first and second predetermined threshold rates, respectively, meets the respective predetermined threshold rate.

9. A system for detecting vapor leaks, comprising:

a detection system configured to detect vapor leaks of a predetermined diameter in a liquid storage system, the detection system comprising a liquid removal monitoring system coupled to the processor and configured to monitor the removal of liquid from the tank and to provide liquid removal information to the processor;

a processor coupled to the detection system and configured to determine the rate of removal of liquid from the tank and to restrict the detection system from detecting vapor leaks when the rate of liquid removal from the tank meets a predetermined threshold rate; and the processor is configured to determine a liquid removal rate during a period of time when the correction system is in a correction detection mode and a liquid removal rate during a period of time when the detection system is in a leak detection mode, and to compare the first and second liquid removal rates to first and second predetermined threshold rates and restrict the leak detection system when either of the first and second liquid removal rates meets the respective first and second predetermined threshold rates.

10. The system of claim 9 wherein the processor is configured to determine the rate of vapor pressure change and to compare the rate of vapor pressure change to a predetermined value and suspend leak detection when the rate of vapor pressure change meets the predetermined threshold value.

11. The system of claim 9 wherein the predetermined threshold value corresponds to an atmospheric pressure.

12. The system of claim 9 wherein the predetermined value corresponds to a rise in vapor pressure generated from vapor in the tank.

* * * * *

UNITED STATES PATENT AND TRADEMARK OFFICE

CERTIFICATE OF CORRECTION

PATENT NO. : 6,363,919 B1
DATED : April 2, 2002
INVENTOR(S) : Takashi Isobe et al.

It is certified that error appears in the above-identified patent and that said Letters Patent is hereby corrected as shown below:

Column 16, lines 39-56 through Column 17, lines 1-5,

Claim 4, "A fuel distribution pipe in a fuel injection apparatus which increase a pressure of a fuel within a fuel source by a fuel pump to supply to the fuel distribution pipe and inject and supply the fuel to an engine via a fuel injection valve attached to the fuel distribution pipe, characterized that the fuel distribution path is pierced along a line X—X in a direction of a longitudinal axis of the fuel distribution pipe and an injection valve supporting hole for inserting and supporting a rear end portion of the fuel injection valve and a fuel introduction path for supplying a fuel having a pressure increased by a fuel pump are continuously provided in said fuel distribution path of the fuel distribution pipe, and that a cooling water flow path extending along the line X—X in the direction of the longitudinal axis of the fuel distribution path and sectioned from the fuel distribution path is provided on an outer periphery of said fuel distribution path, thereby introducing a cooling water into said cooling water flow path; wherein the fuel distribution path disposed along the line X—X in the direction of the longitudinal axis within the fuel distribution pipe is formed so as to be sectioned from the cooling water flow path by forming the fuel distribution path and the cooling water flow path in said fuel distribution pipe by a drawing process along the line X—X in the direction of the longitudinal axis and closing the fuel distribution path and the cooling water flow path respectively open to one end portion and another end portion of the fuel distribution pipe by one side closing member and another side closing member; wherein the fuel introduction path connected to the fuel distribution path and the cooling water introduction path and the cooling water discharge path connected to the cooling water flow path are provided in said one side closing member." should read -- The system of claim 2, wherein the processor is configured to determine the rate of vapor pressure change and to compare the rate of vapor pressure change to a predetermined value and suspend leak detection when the rate of vapor pressure change meets the predetermined threshold value. --.

UNITED STATES PATENT AND TRADEMARK OFFICE

CERTIFICATE OF CORRECTION

PATENT NO. : 6,363,919 B1
DATED : April 2, 2002
INVENTOR(S) : Takashi Isobe et al.

It is certified that error appears in the above-identified patent and that said Letters Patent is hereby corrected as shown below:

Column 17,
Lines 6-41,

Claim 5, "A fuel distribution pipe in a fuel injection apparatus which increase a pressure of a fuel within a fuel source by a fuel pump to supply to the fuel distribution pipe and inject and supply the fuel to an engine via a fuel injection valve attached to the fuel distribution pipe, characterized that the fuel distribution path is pierced along a line X—X in a direction of a longitudinal axis of the fuel distribution pipe and an injection valve supporting hole for inserting and supporting a rear end portion of the fuel injection valve and a fuel introduction path for supplying a fuel having a pressure increased by a fuel pump are continuously provided in said fuel distribution path of the fuel distribution pipe, and that a cooling water flow path extending along the line X—X in the direction of the longitudinal axis of the fuel distribution path and sectioned from the fuel distribution path is provided on an outer periphery of said fuel distribution path, thereby introducing a cooling water into said cooling water flow path; wherein the fuel distribution path disposed along the line X—X in the direction of the longitudinal axis within the fuel distribution pipe is formed so as to be sectioned from the cooling water flow path by forming the fuel distribution path and the cooling water flow path in said fuel distribution pipe by a drawing process along the line X—X in the direction of the longitudinal axis and closing the fuel distribution path and the cooling water flow path respectively open to one end portion and another end portion of the fuel distribution pipe by one side closing member and another side closing member; wherein the fuel introduction path connected to the fuel distribution path and the cooling water introduction path connected to the cooling water flow path are provided in said one side closing member, and the cooling water discharge path connected to the cooling water flow path is provided in said another side closing member." should read -- The system of claim 7 wherein the petermined threshold value corresponds to an atmospheric pressure. --.

Signed and Sealed this

Fifteenth Day of July, 2003

JAMES E. ROGAN
*Director of the United States Patent and Trademark Office*